US007549646B2

(12) United States Patent
Yumiya

(10) Patent No.: US 7,549,646 B2
(45) Date of Patent: Jun. 23, 2009

(54) CRANE GAME MACHINE

(75) Inventor: Kenji Yumiya, Yokohama (JP)

(73) Assignee: Taito Corporation, Tokyo (JP)

( * ) Notice: Subject to any disclaimer, the term of this patent is extended or adjusted under 35 U.S.C. 154(b) by 559 days.

(21) Appl. No.: 11/398,698

(22) Filed: Apr. 6, 2006

(65) Prior Publication Data

US 2006/0249909 A1 Nov. 9, 2006

(30) Foreign Application Priority Data

Apr. 20, 2005 (JP) ..... 2005-122579
Mar. 29, 2006 (JP) ..... 2006-089786

(51) Int. Cl.
*A63F 9/30* (2006.01)

(52) U.S. Cl. ..... 273/448; 273/447; 463/7

(58) Field of Classification Search ..... 273/440, 273/447, 448; 463/7
See application file for complete search history.

(56) References Cited

U.S. PATENT DOCUMENTS 5,358,219 A * 10/1994 Shenk et al. ..... 254/269
5,397,134 A * 3/1995 Fishman et al. ..... 463/25
5,415,417 A * 5/1995 Reis, Jr. ..... 273/447
6,283,475 B1 * 9/2001 Stubben ..... 273/448
6,595,521 B2 * 7/2003 Uedono et al. ..... 273/448
6,634,940 B2 * 10/2003 Yoshida et al. ..... 463/7
6,899,337 B2 * 5/2005 Fisher et al. ..... 273/447
2002/0067002 A1 * 6/2002 Yoshida et al. ..... 273/447
2006/0249909 A1 * 11/2006 Yumiya ..... 273/447

FOREIGN PATENT DOCUMENTS

JP 2613597 2/1997
JP 2001-15772 6/2001
JP 2006320710 A * 11/2006
JP 2007289449 A * 11/2007

* cited by examiner

*Primary Examiner*—Raleigh W. Chiu
(74) *Attorney, Agent, or Firm*—Oblon, Spivak, McClelland, Maier & Neustadt, P.C.

(57) ABSTRACT

There is provided a crane game machine which has a simple structure and can perform fine control on a catcher. In this invention, a CPU increments a counter value at a clock signal period of a timer when a crane is to be moved down, and decrements the counter value at the clock signal period of the timer when the crane is to be moved up. When the counter value becomes equal to or more than a predetermined value, the operation of an elevating motor is stopped.

5 Claims, 12 Drawing Sheets

71

| Identification information of IC tag | Operation at stop of movement |
|---|---|
| ID of floor surface IC tag | Operation corresponding to floor surface |
| ID of IC tag of expensive prize | Operation corresponding to expensive prize |
| ID of IC tag of inexpensive prize | Operation corresponding to inexpensive prize |
| ⋮ | ⋮ |

CRANE GAME MACHINE

CROSS-REFERENCE TO RELATED APPLICATIONS

This application is based upon and claims the benefit of priority from prior Japanese Patent Applications No. 2005-122579, filed Apr. 20, 2005; and No. 2006-089786, filed Mar. 29, 2006, the entire contents of both of which are incorporated herein by reference.

BACKGROUND OF THE INVENTION

1. Field of the Invention

The present invention relates to a crane game machine.

2. Description of the Related Art

A crane game machine is designed such that when a player translates a prize catcher portion back and forth and left and right to move it to immediately above a prize which a player wants to obtain, the catcher moves down to the prize and grasps it, moves up while grasping the prize, moves horizontally to a prize drop-in port, and then releases the prize, thereby providing the prize to the player.

Such a crane game machine is generally provided with limit switches for stopping the back and forth movement, left and right movement, and up and down movement of the catcher at the respective movement limits. For the down movement of the catcher, this machine is provided with a mechanism of detecting the slack of a wire when the catcher moves down on stacked prizes, and stopping letting out the wire for the down movement of the catcher (see, e.g., Japanese Patent No. 2613597).

However, when the mechanism for detecting such slack of the wire and stopping letting out the wire is to move the catcher down above the prize drop-in port, the mechanism cannot stop moving the catcher down before the catcher enters the prize drop-in port.

Another type of crane game machine has been developed (e.g., Jpn. Pat. Appln. KOKAI Publication No. 2001-157772), which measures the number of revolutions of a wire take-up pulley and stops moving the catcher down upon comparing the measured number of revolutions with a limit value instead of using the limit switches of the mechanism for stopping letting out the wire for the down movement of the catcher.

Stop control on the up and down movement of the catcher of such a crane game machine will be described below.

A catcher elevating motor is interlocked with a wire take-up pulley through a gear, and a wire is wound around the wire take-up pulley. The other end of the wire is connected to a catcher through an extendible pipe. A shield plate which shields a photosensor is fixed to one end of the periphery of the wire take-up pulley. With this arrangement, the number of revolutions of the wire take-up pulley is counted.

A control board incorporated in the main body of the crane game machine detects a rise signal generated when a down push button is pressed, counts the number of revolutions of the wire take-up pulley which is sent from the photosensor, and automatically performs stop control on the catcher elevating motor when the number of revolutions reach a maximum number n of turns given by expression (1) in accordance with a predetermined program.

$$L>=2\pi\cdot r\cdot n \quad (1)$$

where L is the distance from the lowest end of the grip pawl of the catcher to a prize mount plate, r is the radius of the pulley, and n is the number of revolutions of the pulley.

In stop control on the up and down movement of the catcher with the above arrangement, however, since parts such as a photosensor and shield plate are required, a complicated mechanism is required, resulting in a high failure rate.

In addition, since the mechanism of the driving portion is complicated, the weight of the portion increases. As a consequence, the response with respect to operation decreases as compared with a case without such a mechanism. In order to prevent a decrease in response, a high-performance motor needs to be selected, resulting in higher part costs.

If one shield plate and one photosensor are used to count the number of times the shield plate blocks the photosensor, the number of revolutions which can be detected is limited to an integral value. However, when the maximum number n of turns to be set is to be changed, e.g., a case wherein the level of the prize mount plate is to be changed or a case wherein a lower limit is to be set in a place where the prize mount plate does not exist, e.g., the prize drop-in port, there may occur a case which cannot be handled with integral values. When control is to be performed with a finer number of revolutions than for control based on an integral value, the numbers of photosensors and shielding plates need to be increased. However, such numbers which can be increased are structurally limited, and the fineness of the number of revolutions which can be detected is limited. In addition, as the above structure problem becomes more eminent, it becomes necessary to find some comprise in terms of design.

Furthermore, the conventional crane game machine cannot recognize information concerning prizes, and hence fine control corresponding to the types of prizes cannot be performed.

BRIEF SUMMARY OF THE INVENTION

The present invention has been made in consideration of the above situations, and has as its object to provide a crane game machine which has a simple structure and can perform fine control.

In order to achieve the above object, according to the first aspect of the present invention, there is provided a crane game machine comprising: a crane; a control panel which issues an instruction to operate the crane; a moving mechanism which moves the crane in accordance with the instruction; a counter which is used to control the crane; counter control means for changing a counter value of the counter by a first value at a time at predetermined time intervals while the instruction instructs to move the crane up, and changing the counter value of the counter by a second value at a time at predetermined time intervals while the instruction instructs to move the crane down; determination means for determining whether the counter value coincides with a predetermined condition; and stop means for stopping down movement of the crane moved by the moving mechanism when it is determined that the counter value coincides with the predetermined condition.

According to the second aspect of the present invention, there is provided a machine according to the first aspect, which further comprises detection means for detecting slack of a wire attached to a mechanism of the crane which catches a prize, and in which the stop means stops down movement of the crane moved by the moving mechanism when slack of the wire is detected.

According to the third aspect of the present invention, there is provided a machine according to the first aspect, further comprising transmission antennas which are respectively attached to a floor surface on which prizes for the crane game machine are placed and around a drop-in port for the prizes; a reception antenna which is attached to the crane and receives radio waves from the transmission antennas; means for detecting an electric field strength of a radio wave received by the reception antenna; means for detecting that the detected electric field strength is higher than a predetermined electric field strength; and means for stopping down movement of the crane moved by the moving mechanism when it is detected that the detected electric field strength is higher than the predetermined electric field strength.

According to the fourth aspect of the present invention, there is provided a machine according to the first aspect, further comprising means for detecting identification information of an IC tag attached to a prize for the crane game machine, a table which stores identification information of each IC tag and operation at stop of movement in association with each other, and means for, when the identification information of the IC tag is detected, stopping down movement of the crane moved by the moving mechanism, and causing the crane to perform operation at stop of movement which is associated with the detected identification information of the IC tag upon looking up the table.

According to the fifth aspect of the present invention, there is provided a machine according to the first aspect, further comprising an ultrasound sensor attached to the crane; means for detecting an intensity of an ultrasound wave which is transmitted from the ultrasound sensor and reflected by the floor surface on which prizes for the crane game machine are placed, means for detecting that the detected intensity of the ultrasound wave is not less than a predetermined intensity; and means for stopping down movement of the crane moved by the moving mechanism when it is detected that the detected intensity of the ultrasound wave is not less than the predetermined intensity.

According to the sixth aspect of the present invention, there is provided a crane game machine comprising: a crane; a control panel which issues an instruction to operate the crane; a moving mechanism which moves the crane in accordance with the instruction; transmission antennas which are respectively attached to a floor surface on which prizes for the crane game machine are placed and around a drop-in port for the prizes; a reception antenna which is attached to the crane and receives radio waves from the transmission antennas; means for detecting an electric field strength of a radio wave received by the reception antenna; means for detecting that the detected electric field strength is higher than a predetermined electric field strength; and means for stopping down movement of the crane moved by the moving mechanism when it is detected that the detected electric field strength is higher than the predetermined electric field strength.

According to the seventh aspect of the present invention, there is provided a crane game machine comprising: a crane; a control panel which issues an instruction to operate the crane; a moving mechanism which moves the crane in accordance with the instruction; means for detecting identification information of an IC tag attached to a prize for the crane game machine; a table which stores identification information of each IC tag and operation at stop of movement in association with each other; and means for, when the identification information of the IC tag is detected, stopping down movement of the crane moved by the moving mechanism, and causing the crane to perform operation at stop of movement which is associated with the detected identification information of the IC tag upon looking up the table.

BRIEF DESCRIPTION OF THE SEVERAL VIEWS OF THE DRAWING

FIG. 3A is a timing chart for explaining an operation clock signal and the like;

FIG. 3B is a timing chart for explaining a timer clock signal;

FIG. 3C is a timing chart for explaining a status signal for a motor;

DETAILED DESCRIPTION OF THE INVENTION

Crane game machines according to embodiments of the present invention will be described below with reference to the views of the accompanying drawing.

First Embodiment

Figure 1:
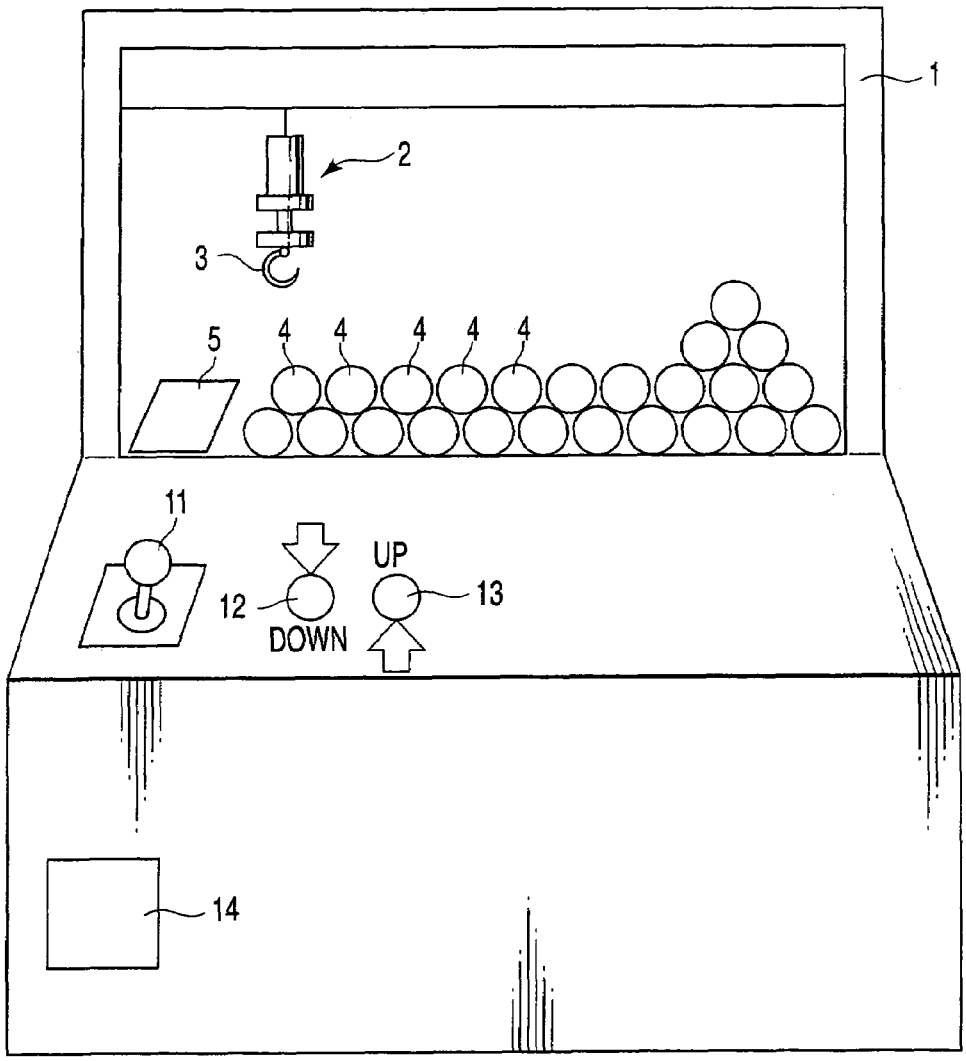
FIG. 1 is a view showing the arrangement of a crane game machine according to the first embodiment of the present invention.

FIG. 1 is a view showing the arrangement of a crane game machine according to the first embodiment of the present invention.

As shown in FIG. 1, a crane game machine 1 is provided with a crane 2 having a hook 3 for hooking a prize 4. The crane 2 can move back and forth, and left and right by using mechanisms (not shown), and can open and close the hook 3 in accordance with the operation of a joystick.

The crane 2 moves down by using a mechanism (not shown) while a down button 12 is pressed, and moves up by using a mechanism (not shown) while an up button 13 is pressed.

The crane game machine 1 is also provided with a prize drop-in port 5 into which the prize 4 hooked on the hook 3 of the crane 2 is to be dropped. The prize 4 dropped into the prize drop-in port 5 can be removed from a prize dispensing portion 14.

Figure 2:
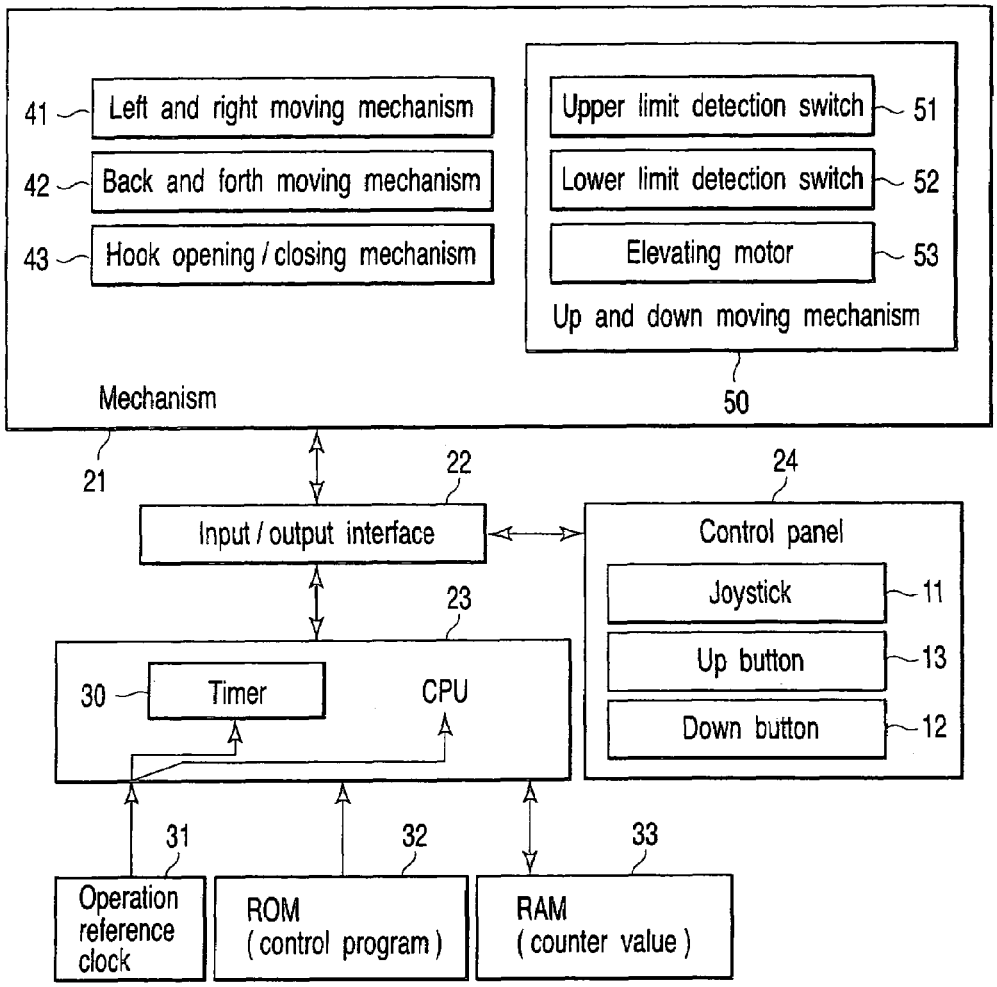
FIG. 2 is a block diagram showing the function of the crane game machine.

FIG. 2 is a block diagram showing the function of the crane game machine.

As shown in FIG. 2, the crane game machine has a mechanism 21, input/output interface 22, CPU 23, control panel 24, operation reference clock 31, ROM 32, and RAM 33.

The mechanism 21 has a left and right moving mechanism 41, back and forth moving mechanism 42, hook opening/closing mechanism 43, and up and down moving mechanism 50.

The left and right moving mechanism 41 moves the crane 2 in the left or right direction in accordance with the left or right movement of the joystick 11. The back and forth moving mechanism 42 moves the crane 2 in the back or forth direction in accordance with the back or forth movement of the joystick 11. The hook opening/closing mechanism 43 opens and closes the hook 3 of the crane 2.

The up and down moving mechanism 50 is a mechanism for moving the crane 2 in the up or down direction, and comprises an upper limit detection switch 51, lower limit detection switch 52, and elevating motor 53.

The upper limit detection switch 51 detects the upper limit of the movable range of the crane 2 in a hardware manner. The lower limit detection switch 52 detects the lower limit of the movable range of the crane 2 in a hardware manner. The arrangement of the upper limit detection switch 51 and lower limit detection switch 52 is a known technique and disclosed in, for example, Japanese Patent No. 2613597. Assume that in this embodiment, as disclosed in Japanese Patent No. 2613597, the lower limit detection switch 52 is a mechanism for limiting the down movement of the crane 2 by detecting the slack of a wire (not shown) attached to the hook 3 of the crane 2. The elevating motor 53 drives the mechanism for moving the crane 2 in the up or down direction, and operates on the basis of an instruction from the CPU 23.

Note that the left and right moving mechanism 41, back and forth moving mechanism 42, and hook opening/closing mechanism 43 respectively have motors for driving the respective mechanisms. These motors operate on the basis of instructions from the CPU 23.

The control panel 24 has the joystick 11, down button 12, and up button 13. Signals representing the states of the joystick 11, down button 12, and up button 13 are input to the CPU 23 through the input/output interface 22.

Figures 3A, 3B, 3C:
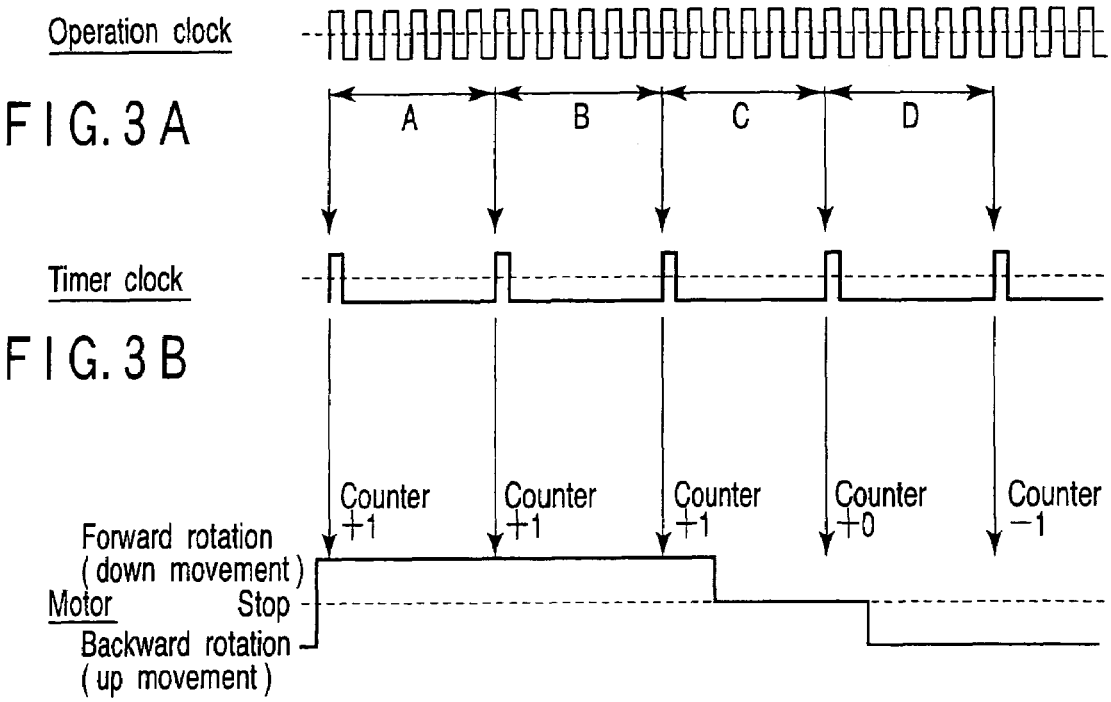
Figure 4:
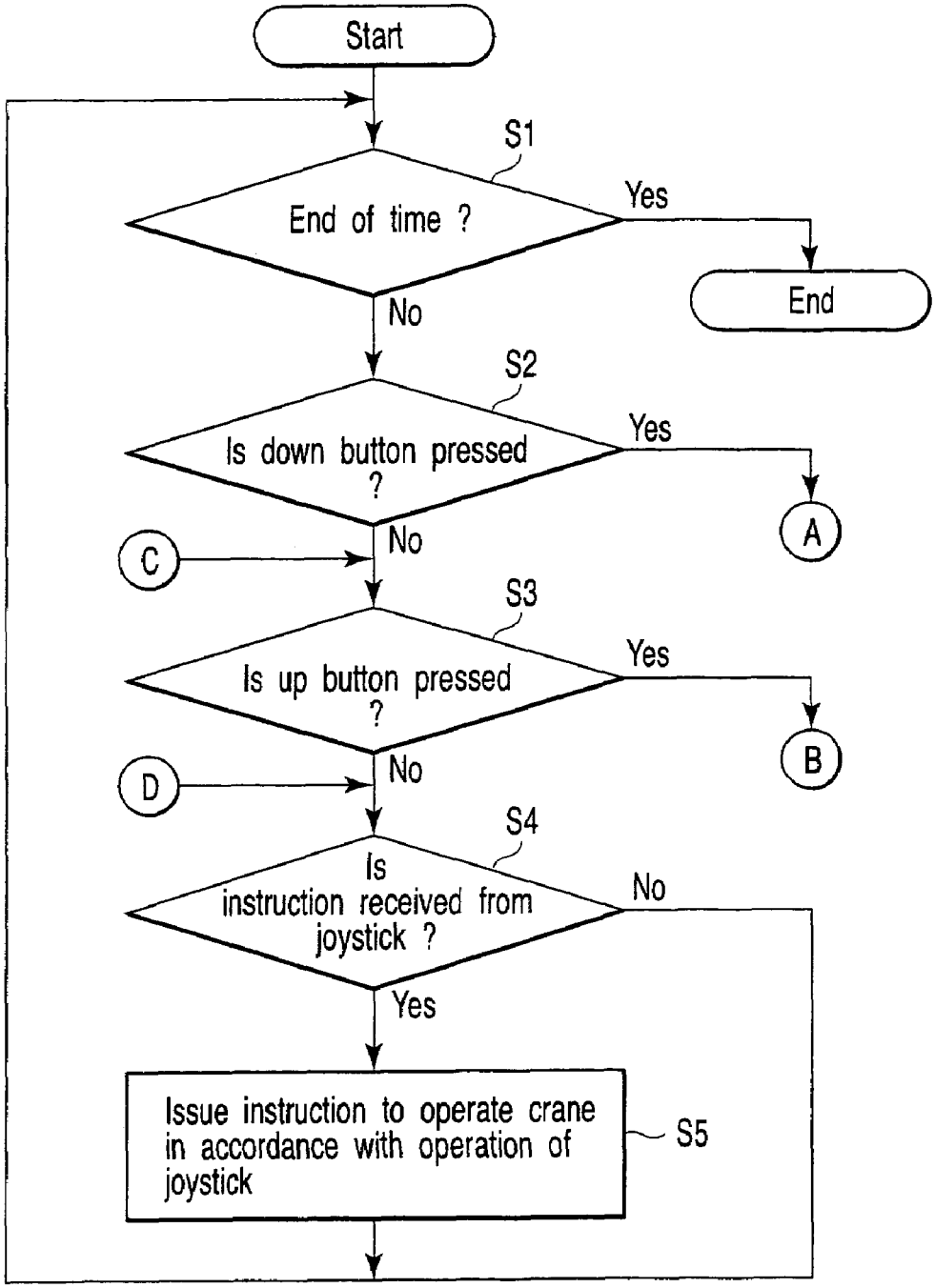
FIG. 4 is a flowchart for explaining the operation of the crane game machine according to the first embodiment of the present invention.
Figure 5:
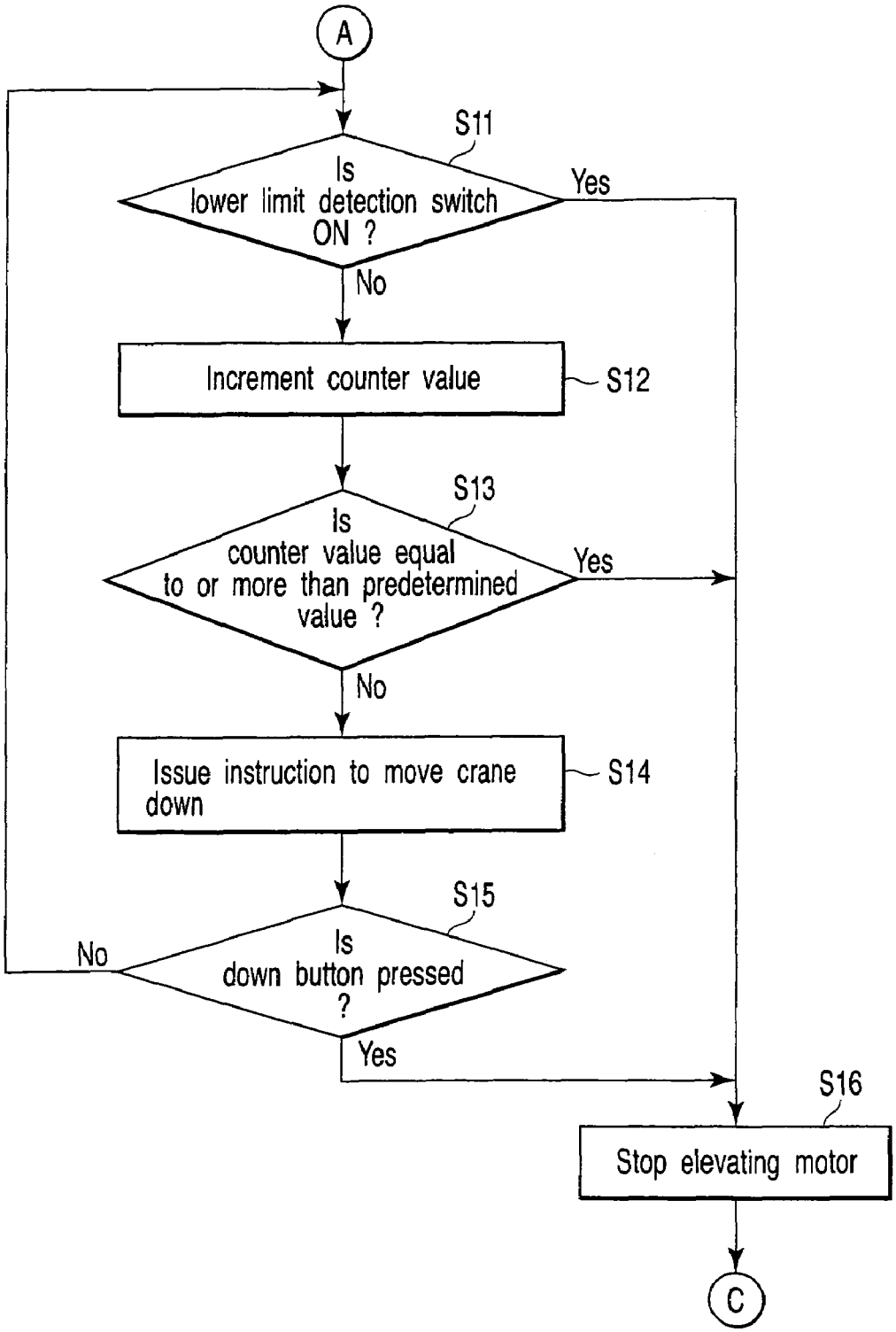
FIG. 5 is a flowchart for explaining the operation of the crane game machine according to the first embodiment of the present invention.
Figure 6:
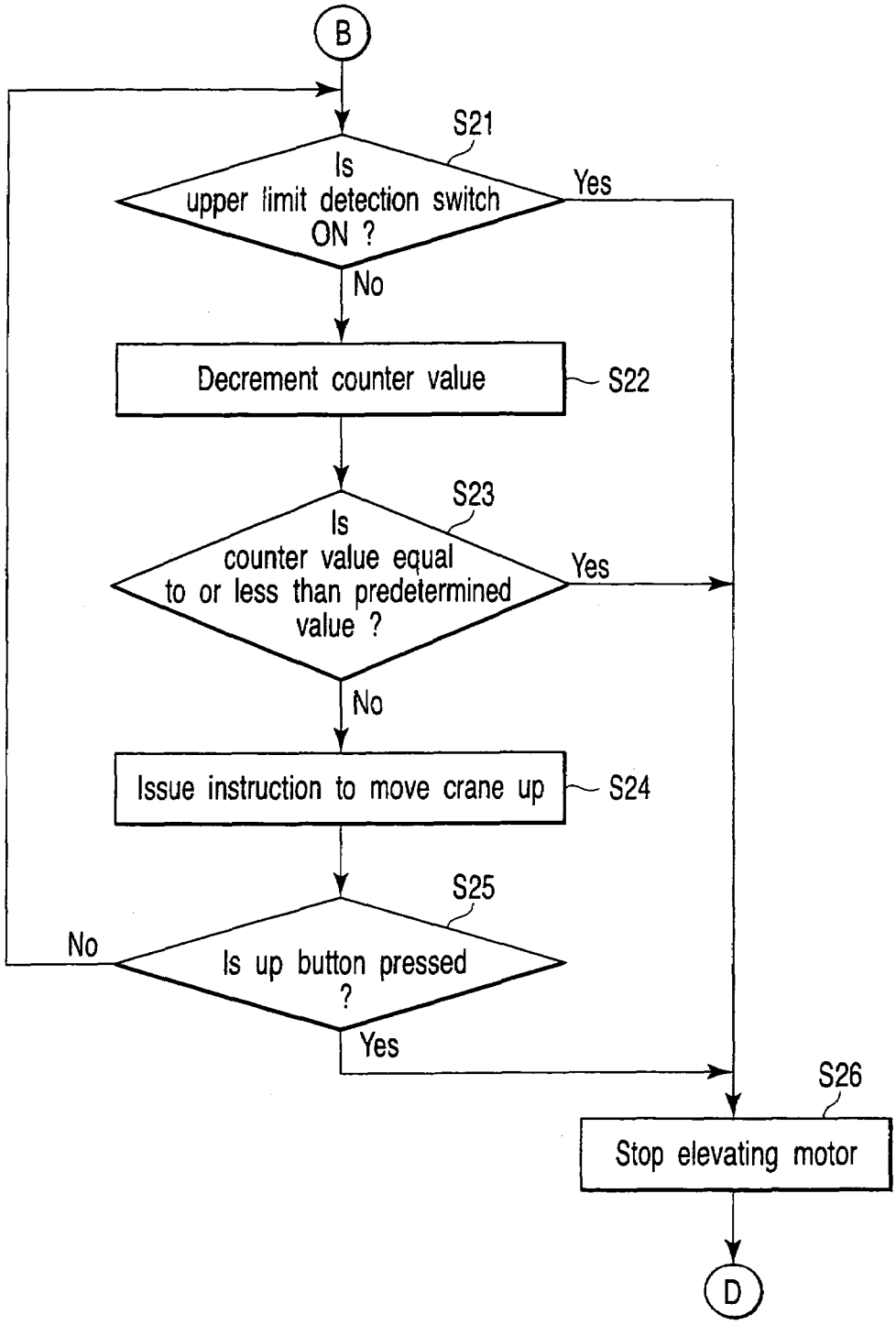
FIG. 6 is a flowchart for explaining the operation of the crane game machine according to the first embodiment of the present invention.

The CPU 23 controls the overall crane game machine according to the first embodiment of the present invention by executing crane control programs stored in the ROM 32, and performs the processing shown in flowcharts of FIGS. 4 to 6. The CPU 23 has a timer 30. The timer 30 outputs the timer clocks shown in FIG. 3B, which is obtained by frequency-dividing an operation clock supplied from the operation reference clock 31 shown in FIG. 3A.

The CPU 23 monitors the status signal shown in FIG. 3C which is output from the elevating motor 53 for every period of this timer clock, and increments the counter value of a software counter by one when the value of the status signal is positive, i.e., the elevating motor 53 rotates forward (moves down). If the value of the status signal is negative, i.e., the elevating motor 53 rotates backward (moves up), the CPU 23 decrements the counter value of the software counter by one. If the value of the status signal is 0, i.e., the elevating motor 53 stops, the counter value of the software counter does not change. The counter value of the software counter is stored in the RAM 33.

The CPU 23 also receives signals indicating the states of the joystick 11, down button 12, and up button 13, a signal indicating the state of the elevating motor 53, and detection signals from the upper limit detection switch 51 and the lower limit detection switch 52, and performs processing, e.g., outputting control signals to the left and right moving mechanism 41, back and forth moving mechanism 42, hook opening/closing mechanism 43, and elevating motor 53.

The operation of the crane game machine according to the first embodiment of the present invention will be described next with reference to the flowcharts of FIGS. 4 to 6.

When a player starts to play the crane game machine, the timer 30 measures an elapsed time at the start of the play. In step S1, it is determined whether the measured elapsed time has reached a predetermined time, thereby determining whether the play time has expired (S1).

If it is determined in step S1 that the measured elapsed time has reached the predetermined time, and the play time has ended, the processing is terminated. If it is determined that the play time has not ended, it is determined whether the down button 12 is pressed (S2). Whether the down button 12 is pressed is determined by the CPU 23 on the basis of a signal indicating the state of the down button 12 which is input from the control panel 24 through the input/output interface 22.

If it is determined in step S2 that the down button 12 is not pressed, it is determined whether the up button 13 is pressed (S3). Whether the up button 13 is pressed is determined by the CPU 23 on the basis of a signal indicating the state of the up button 13 which is input from the control panel 24 through the input/output interface 22.

If it is determined in step S3 that the up button 13 is not pressed, it is determined whether any instruction is received from the joystick 11 (S4). Whether this instruction is received from the joystick 11 is determined by the CPU 23 on the basis of a signal indicating the state of the joystick 11 which is input from the control panel 24 through the input/output interface 22.

If it is determined in step S4 that no instruction is received from the joystick 11, the flow returns to the processing in step S1. If it is determined that an instruction is received from the joystick 11, the CPU 23 instructs the left and right moving mechanism 41 and back and forth moving mechanism 42 to move the crane 2 (S5) in accordance with the operation of the joystick 11, and the flow returns to the processing in step S1.

That is, while the joystick 11 is tilted to the left or right, the CPU 23 instructs the left and right moving mechanism 41 to move the crane 2 to the left or right. While the joystick 11 is tilted to the front or back, the CPU 23 instructs the back and forth moving mechanism 42 to move the crane 2 to the front or back. Note that the moving ranges of the crane 2 in the up or down direction and the left or right direction are determined in advance. Assume that an instruction to move the crane beyond the moving ranges in the upper or down direction or the left or right direction is received from the crane 2. In this case, even if the CPU 23 issues an instruction, the elevating motor 53 does not operate.

If it is determined step S2 that the down button 12 is pressed, it is determined whether the lower limit of the crane 2 is detected by the lower limit detection switch 52 (S11).

If it is determined in step S11 that the lower limit of the crane 2 is not detected, the counter value is incremented (S12). It is then determined whether the counter value is equal to or more than a predetermined value (S13).

If it is determined in step S11 that the lower limit of the crane 2 is detected by the lower limit detection switch 52, and it is determined that the counter value is equal to or more than the predetermined value, the elevating motor 53 is stopped (S16) to prevent the crane 2 from moving down. The flow then shifts to the processing in step S3.

If it is determined in step S13 that the counter value is not equal to or more than the predetermined value, the CPU 23 issues a forward rotation (down movement) instruction to the elevating motor 53 to move the crane 2 down (S14). It is then determined whether the down button 12 is released (S15). The flow returns to the processing in step S11 if it is determined that the down button 12 is not released. If it is determined in step S15 that the down button 12 is released, the elevating motor 53 is stopped (S16) to prevent the crane 2 from moving down. The flow then shifts to the processing in step S3.

If it is determined in step S3 that the up button is pressed, it is determined whether the upper limit of the crane 2 is detected by the upper limit detection switch 51 (S21).

If it is determined in step S21 that the upper limit of the crane 2 is not detected, the counter value is decremented (S22). It is then determined whether the counter value is equal to or less than a predetermined value (S23).

If it is determined in step S21 that the upper limit of the crane 2 is detected by the upper limit detection switch 51, and it is determined that the counter value is equal to or less than the predetermined value, the CPU 23 stops the elevating motor 53 (S26) to prevent the crane 2 from moving up. The flow then shifts to the processing in step S4.

If it is determined in step S23 that the counter value is not equal to or less than the predetermined value, the CPU 23 issues a backward rotation (up movement) instruction to the elevating motor 53 to move the crane 2 up (S24). It is then determined whether the down button 12 is released (S25). If it is determined that the down button 12 is not released, the flow returns to the processing in step S21. If it is determined in step S25 that the down button 12 is released, the CPU 23 stops the elevating motor 53 (S26) to prevent the crane 2 from moving up. The flow then shifts to the processing in step S4.

In the above embodiment, when the crane 2 is to be moved up, the counter value is decreased, and vice versa. However, when the crane 2 is to be moved up, the counter value may be increased, and vice versa. In this case, when the crane 2 is moved up and the counter value is equal to or more than a predetermined value, the elevating motor 53 is stopped. When the crane 2 is moved down and the counter value is equal to or less than the predetermined value, the elevating motor 53 is stopped. In addition, the counter value is changed by "1" or "−1". However, the present invention is not limited to this.

In the crane game machine according to the embodiment of the present invention, when the crane is moved down in an area where the prize mount plate exists, stop control on the crane can be performed by using the lower limit detection switch which detects the lower limit by detecting the slack of the wire. In an area where the prize mount plate does not exist, e.g., an area where the prize drop-in port exists, stop control can be performed by using the counter value of the counter (two-step control). This makes it possible to set a wide movable range for the crane.

In addition, since stop control is performed on the basis of the count value of the counter, the down movement distance setting for the crane can be finely changed.

Furthermore, since parts such as a photosensor and a shield plate are not required, the mechanism can be simplified, and the failure rate can be reduced. In addition, since the weight of the driving portion can be suppressed low, the performance of the motor can be reduced. As a consequence, the part cost can be suppressed.

Second Embodiment

A crane game machine according to the second embodiment of the present invention will be described next.

This embodiment differs from the above embodiment in that it detects the lower limit of a crane without using the lower limit detection switch or the counter.

Figure 7:
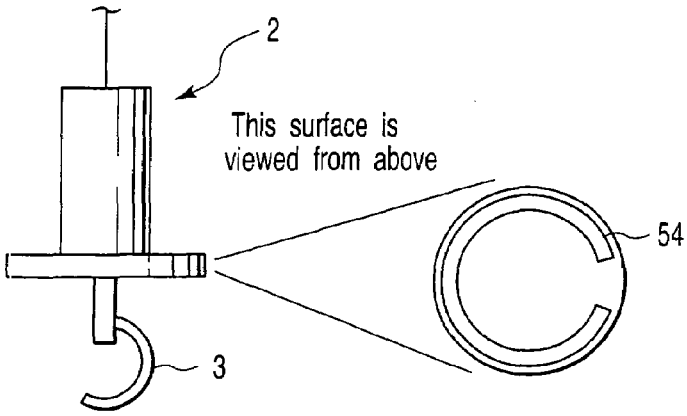
FIG. 7 is a view showing a reception antenna provided on the crane.

In this embodiment, as shown in FIG. 7, a portion of a crane 2 is provided with a reception antenna 54 which receives radio waves from transmission antennas provided on a floor surface on which prizes are mounted. The electric field strength of the radio wave received by the reception antenna 54 is input to a CPU 23.

Note that the reception antenna 54 may be installed at any place as long as its installation position is on the crane 2 near a hook 3. FIG. 7 shows the reception antenna 54 in the form of a loop. However, the shape of the antenna is not limited in particular. Since the reception antenna 54 receives radio waves from the transmission antennas installed on the corresponding floor surface, the directivity of the antenna is preferably narrow in the corresponding floor surface direction. Although no description has been made about power supply systems for the reception antenna 54 and transmission antennas 57, the forms of the power supply systems are not limited in particular.

Figure 8:
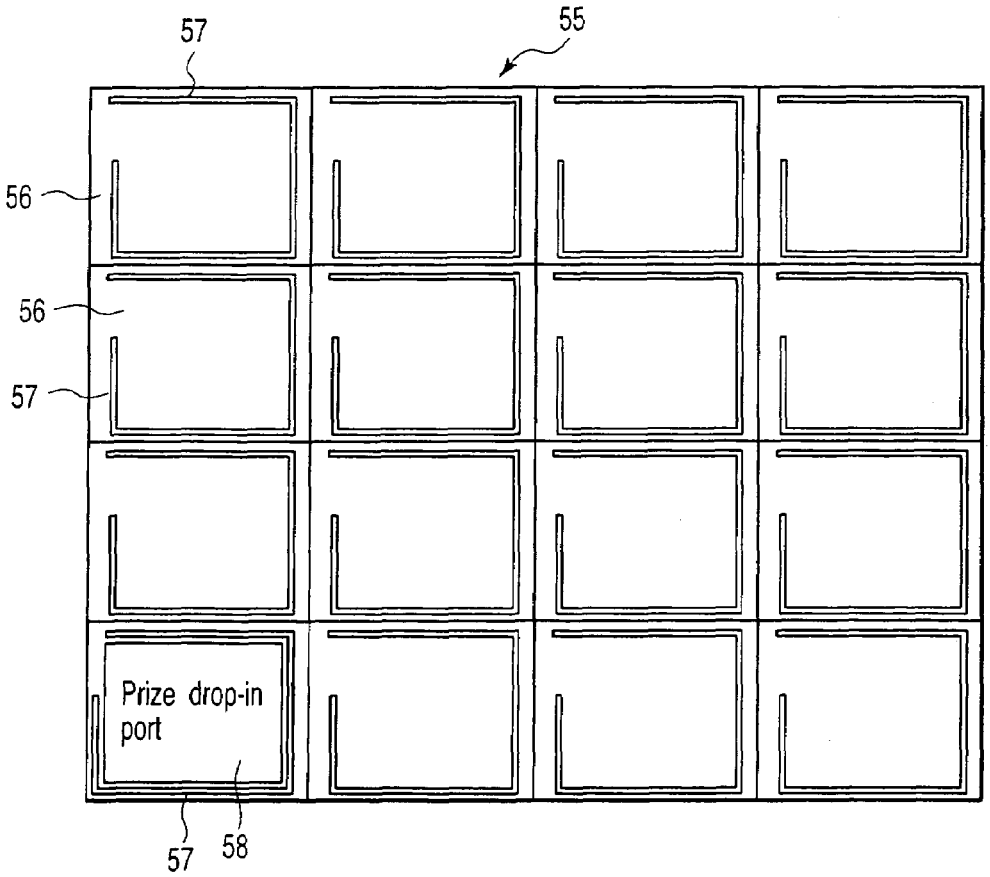
FIG. 8 is a view showing transmission antennas installed on a prize floor surface.

FIG. 8 is a view showing the transmission antennas installed on the prize floor surface.

FIG. 8 shows a state wherein a prize floor surface 55 is divided into a plurality of square units 56, and the transmission antennas 57 are embedded in the respective square units 56.

FIG. 8 shows the transmission antennas 57 in the form of a loop. However, the shape of each antenna is not limited in particular. Note that since each transmission antenna 53 transmits a radio wave to the reception antenna 54 provided on the crane 2, the directivity of the transmission antenna is preferably directed upward from the floor surface.

The transmission antennas 57 may be provided on the surfaces of the units 56 instead of being embedded in them. The units 56 can be moved in the up or down direction and set to introduce changes in crane game. Like the units 56, the transmission antenna 53 is also provided around a prize drop-in port 58.

Figure 9:
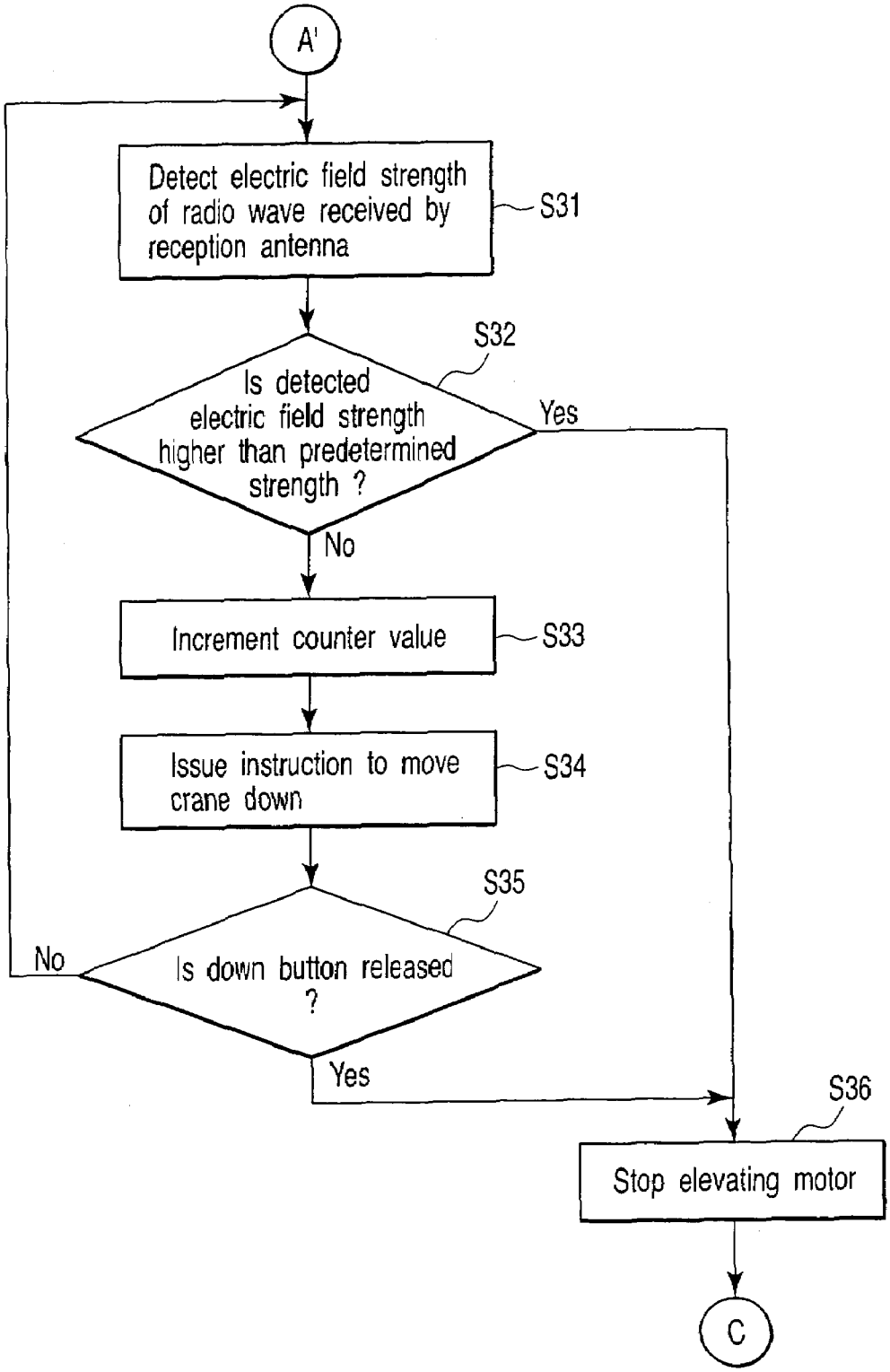
FIG. 9 is a flowchart for explaining the down movement of a crane according to the second embodiment of the present invention.

The operation of the crane game machine according to the embodiment of the present invention will be described with reference to the flowchart of FIG. 9. This operation differs from the operation of the above embodiment in the processing in steps S11 to S16 which is to be performed if it is determined in step S2 of FIG. 4 that the down button is pressed.

That is, in this embodiment, if it is determined in step S2 in FIG. 4 that the down button is pressed, the electric field strength of a radio wave received by the reception antenna 54 is detected by the CPU 23 (S31).

Subsequently, it is determined whether the detected electric field strength is higher than a predetermined electric field strength (S32). If it is determined that the detected electric field strength is higher than the predetermined electric field strength, an elevating motor 53 is stopped (S36) to prevent the crane 2 from moving down. The flow then shifts to the processing in step S3.

If it is determined in step S32 that the detected electric field strength is not higher than the predetermined electric field strength, the counter value is incremented (S33). The CPU 23 issues a forward rotation (down movement) instruction to the elevating motor 53 to move the crane 2 down (S34). It is then determined whether a down button 12 is released (S35). If it is determined that the button is not released, the flow returns to the processing in step S31.

If it is determined in step S35 that the down button 12 is released, the elevating motor 53 is stopped (S36) to prevent the crane 2 from moving down. The flow then shifts to the processing in step S3.

According to the embodiment of the present invention, therefore, since the lower limit of the down movement of the crane is detected in accordance with an electric field strength, any lower limit detection switch need not be used. This makes it possible to simplify the structure of the crane game machine.

In addition, providing the transmission antenna around the prize drop-in port makes it possible to prevent the crane from moving down into the prize drop-in port.

Third Embodiment

A crane game machine according to the third embodiment of the present invention will be described next.

In this embodiment of the present invention, IC tags are attached to a floor, prizes, and the like so that when the identification information of such an IC tag is detected, the down movement of the crane moved by the moving mechanism is stopped, and operation associated with the detected identification information of the IC tag is performed.

Figure 10:
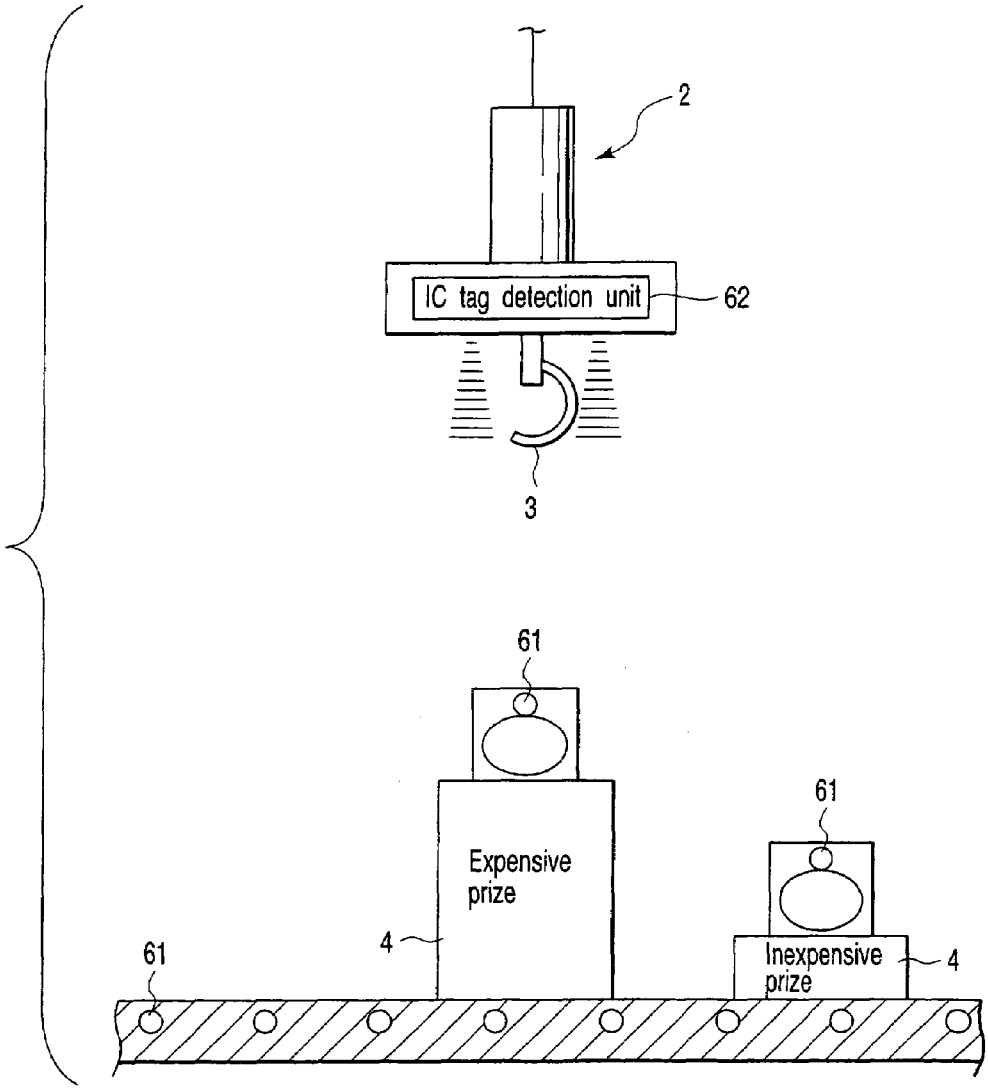
FIG. 10 is a view showing an IC tag detection unit provided for the crane and an IC tag attached to a prize.

In this embodiment, as shown in FIG. 10, IC tags 61 are attached to the floor surface on which prizes are placed and near a portion of each prize on which the hook is to be hooked. When the identification information of the IC tag 61 is detected by an IC tag detection unit 62 incorporated in a crane 2, the down movement of the crane is stopped, and operation corresponding to the detected identification information of the IC tag is performed. Referring to FIG. 10, although not shown, the IC tag 61 is also attached near the prize drop-in port so that the down movement of the crane 2 at the drop-in port can be stopped.

The identification information of each IC tag 61 corresponds to the object to which the tag is attached. For example, the identification information of the IC tag 61 attached to the floor surface has the identification information of the floor surface. The identification information of the IC tag 61 attached to an expensive prize has the identification information of the expensive prize. The identification information of the IC tag 61 attached to an inexpensive prize has the identification information of the inexpensive prize. The identification information of the IC tag 61 attached near the prize drop-in port has the identification information of the prize drop-in port.

The IC tag detection unit 62 may be installed at any place as long as its installation position is on the crane 2 near a hook 3. Note that since the IC tag detection unit 62 detects the IC tags 61 provided for prizes, the floor surface, the drop-in port, and the like, the directivity of a detection radio wave emitted from the IC tag detection unit 62 is preferably directed to the down direction of the crane 2. In addition, although no description has been made about a power supply system for the IC tag detection unit 62, the form of the power supply system is not limited in particular.

Figure 11:
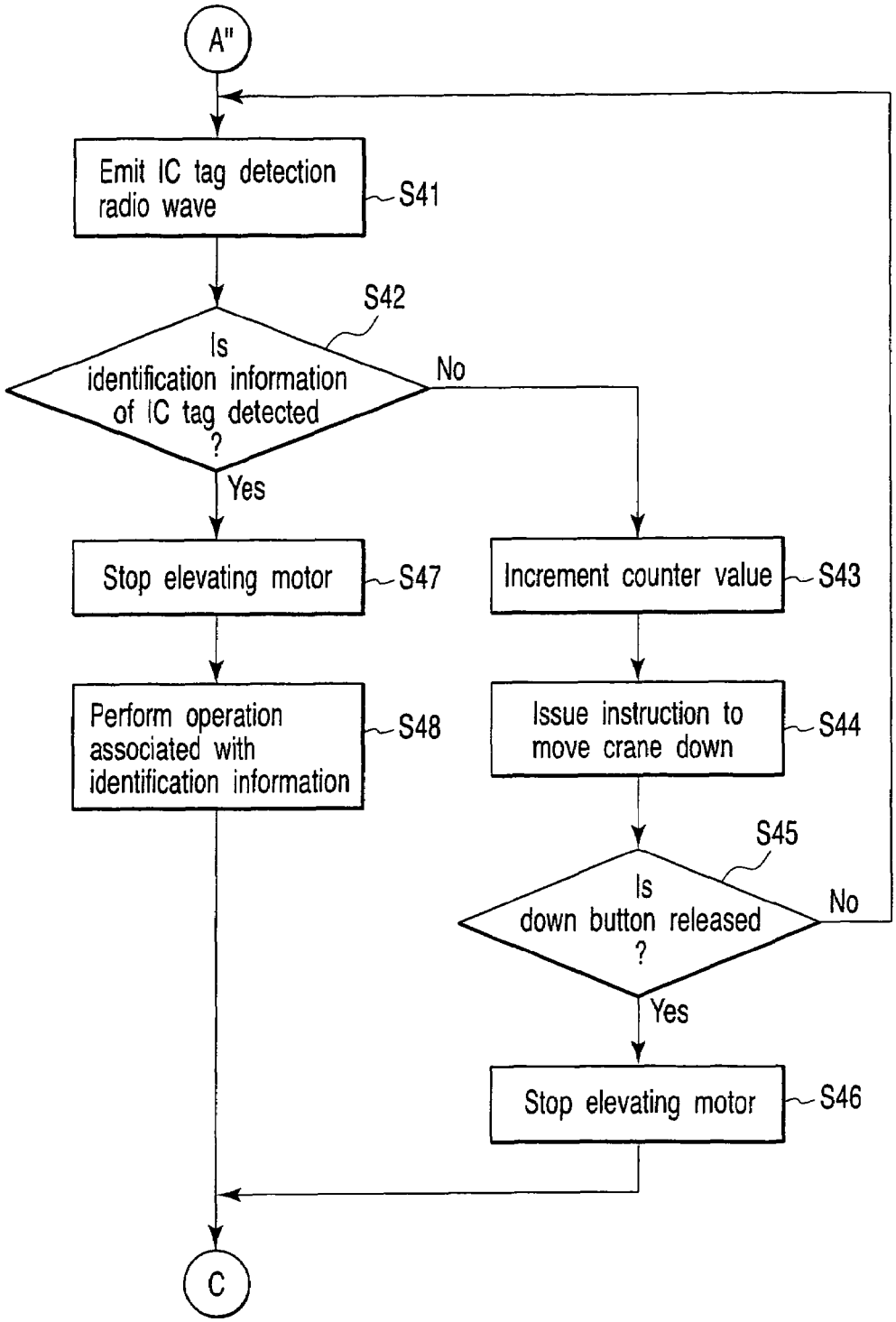
FIG. 11 is a flowchart for explaining the down movement of a crane according to the third embodiment of the present invention.

The operation of the crane game machine according to the embodiment of the present invention will be described next with reference to the flowchart of FIG. 11. This operation differs from the operation of the first embodiment described above in the processing in steps S11 to S16 which is to be performed if it is determined in step S2 in FIG. 4 that the down button is pressed.

That is, in the third embodiment, if it is determined in step S2 in FIG. 4 that the down button is pressed, the IC tag detection unit 62 emits an IC tag detection radio wave (S41).

It is then determined whether the identification information of the IC tag 61 is detected by the IC tag detection unit 62 (S42). If it is determined that the identification information is not detected, the counter value is incremented (S43), and a CPU 23 issues a forward rotation (down movement) instruction to an elevating motor 53 to move the crane 2 down (S44). It is then determined whether a down button 12 is released (S45). If it is determined that the button is not released, the flow returns to the processing in step S41.

If it is determined in step S45 that the down button 12 is released, the elevating motor 53 is stopped (S46) to prevent the crane 2 from moving down. The flow then shifts to the processing in step S3.

If it is determined in step S42 that the identification information of the IC tag is detected, the elevating motor 53 is stopped (S47) to prevent the crane 2 from moving down. The operation of the crane 2 corresponding to the detected identification information of the IC tag is performed (S48).

Figures 12, 13:
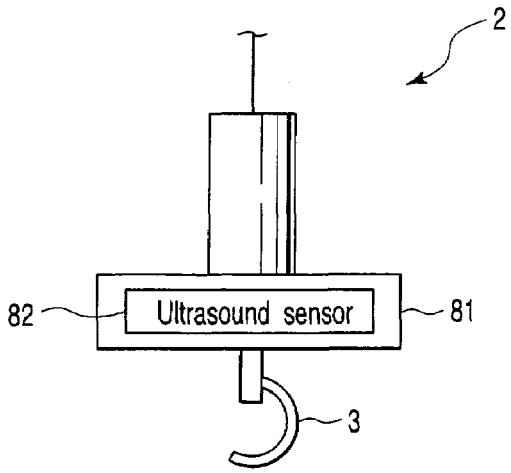
FIG. 12 is a view showing a table in which the identification information of each IC tag and operation at the stop of the crane are stored in association with each other.
FIG. 13 is a view showing an ultrasound sensor provided for the crane.

More specifically, the above operation is implemented in the following manner. A table in which the identification information of each IC tag is associated with operation at the stop of the motor as shown in FIG. 12 is prepared in a memory in the crane game machine. Upon receiving the identification information of the IC tag detected by the IC tag detection unit 62, the CPU 23 searches the table to acquire operation at the stop of the motor which is associated with the detected identification information of the IC tag, and issues an instruction to perform the acquired operation at the stop of the motor to a mechanism 21.

For example, as operation for an expensive prize, operation of stopping the crane at a position slightly shifted from a position where the prize can be easily hooked is defined, whereas as operation for an inexpensive prize, operation of stopping the crane at a position where the prize can be easily hooked is defined. This makes it possible to provide various kinds of crane operations with respect to prizes, thereby providing many variations of crane games.

According to the embodiment of the present invention, since the lower limit of the down movement of the crane is detected by detecting the identification information of an IC tag, any lower limit detection switch need not be used. This makes it possible to simplify the structure of the crane game machine.

Furthermore, in the crane game machine, since pieces of information concerning prizes (the pieces of identification information of IC tags attached to prizes) can be acquired, using the pieces of information concerning the prizes as marketing data makes it possible to perform fine game control.

Note that prize withdrawal adjustment may be effectively performed by making the IC tag detection unit 62 have a data writing function and recording information indicating how many times the IC tag of a given prize has been aimed by players when the identification information of the IC tag is detected.

Fourth Embodiment

A crane game machine according to the fourth embodiment of the present invention will be described next.

This embodiment differs from the above embodiment in that the lower limit of the crane is detected without using any lower limit detection switch or counter.

In this embodiment, as shown in FIG. 13, a portion of a crane 2 is provided with an ultrasound sensor 82 which transmits an ultrasonic wave in the down direction of the crane 2 and detects the intensity of the ultrasound wave reflected by a prize or floor. The intensity of the ultrasound wave detected by the ultrasound sensor 82 is input to a CPU 23.

The ultrasound sensor 82 may be installed at any place as long as its installation position is on the crane 2 near a hook 3. Although no description has been made about a power supply system for the ultrasound sensor 82, the form of the power supply system is not limited in particular. Since the ultrasound sensor 82 is designed to detect prizes and a floor surface, the directivity of an ultrasound wave emitted from the ultrasound sensor 82 is preferably directed to the down direction of the crane 2.

Figure 14:
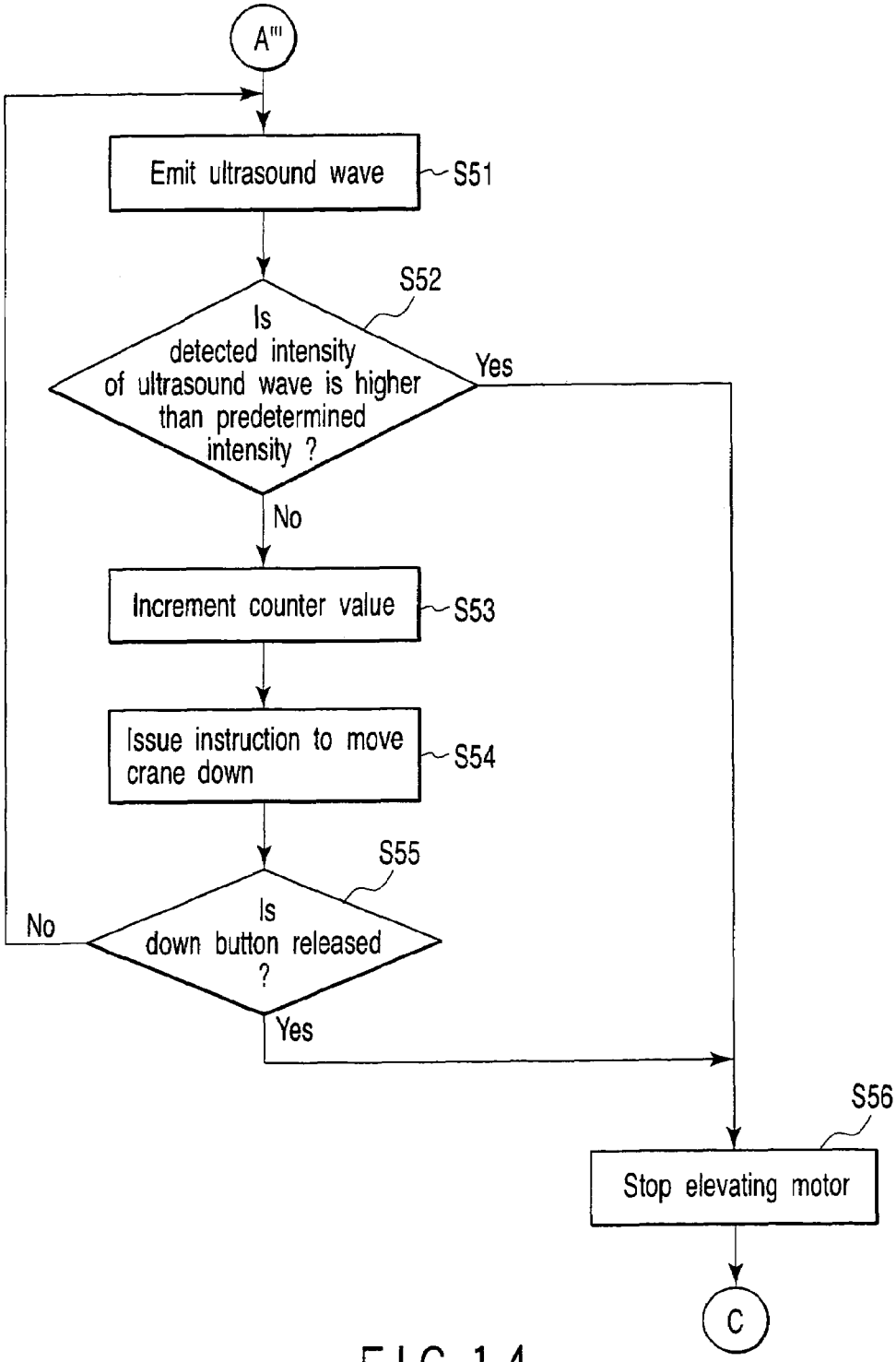
FIG. 14 is a flowchart for explaining the down movement of a crane according to the fourth embodiment of the present invention.

The operation of the crane game machine according to the fourth embodiment of the present invention will be described next with reference to the flowchart of FIG. 14. This operation differs from the operation of the first embodiment in the processing in steps S11 to S16 which is to be performed if it is determined in step S2 in FIG. 4 that the down button is pressed.

That is, in the fourth embodiment, if it is determined in step S2 in FIG. 4 that the down button is pressed, the ultrasound sensor 82 emits an ultrasound wave (S51).

The CPU 23 then determines whether the intensity of the ultrasound wave detected by the ultrasound sensor 82 is higher than a predetermined ultrasound intensity (S52). If it is determined in step S52 that the detected intensity is higher than the predetermined ultrasound intensity, an elevating motor 53 is stopped (S56) to prevent the crane 2 from moving down. The flow shifts to the processing in step S3.

If it is determined in step S52 that the detected intensity is not higher than the predetermined ultrasound intensity, the counter value is incremented (S53). The CPU 23 then issues a forward rotation (down movement) instruction to the elevating motor 53 to move the crane 2 down (S54). It is then determined whether the down button 12 is released (S55). If it is determined that the down button 12 is not released, the flow returns to the processing in step S51.

If it is determined in step S55 that the down button 12 is released, the elevating motor 53 is stopped (S56) to prevent the crane 2 from moving down. The flow then shifts to processing in step S3.

According to the embodiment of the present invention, therefore, since the lower limit of the down movement of the crane is detected in accordance with an ultrasound intensity, any lower limit detection switch need not be used. This makes it possible to simplify the structure of the crane game machine.

The present invention is not limited to the above embodiments, and constituent elements can be modified and embodied in the execution stage within the spirit and scope of the invention. In addition, various inventions can be formed by proper combinations of a plurality of constituent elements disclosed in the above embodiments. For example, several constituent elements may be omitted from all the constituent elements disclosed in the above embodiments. Furthermore, constituent elements in the different embodiments may be properly combined.

What is claimed is:

1. A crane game machine comprising:

a crane;

a control panel which issues an instruction to operate the crane;

a moving mechanism which moves the crane in accordance with the instruction;

a counter which is used to control the crane;

counter control means for changing a counter value of the counter by a first value at a time at predetermined time intervals while the instruction instructs to move the crane up, and changing the counter value of the counter by a second value at a time at predetermined time intervals while the instruction instructs to move the crane down;

determination means for determining whether the counter value coincides with a predetermined condition; and stop means for stopping down movement of the crane moved by the moving mechanism when it is determined that the counter value coincides with the predetermined condition.

2. A machine according to claim 1, which further comprises detection means for detecting slack of a wire attached to a mechanism of the crane which catches a prize, and in which the stop means stops down movement of the crane moved by the moving mechanism when the slack of the wire is detected.

3. A machine according to claim 1, further comprising transmission antennas which are respectively attached to a floor surface on which prizes for the crane game machine are placed and around a drop-in port for the prizes;

a reception antenna which is attached to the crane and receives radio waves from the transmission antennas;

means for detecting an electric field strength of a radio wave received by the reception antenna;

means for detecting that the detected electric field strength is higher than a predetermined electric field strength; and means for stopping down movement of the crane moved by the moving mechanism when it is detected that the detected electric field strength is higher than the predetermined electric field strength.

4. A machine according to claim 1, further comprising means for detecting identification information of an IC tag attached to a prize for the crane game machine, a table which stores identification information of each IC tag and operation at stop of movement in association with each other, and means for, when the identification information of the IC tag is detected, stopping down movement of the crane moved by the moving mechanism, and causing the crane to perform operation at stop of movement which is associated with the detected identification information of the IC tag upon looking up the table.

5. A machine according to claim 1, further comprising an ultrasound sensor attached to the crane;

means for detecting an intensity of an ultrasound wave which is transmitted from the ultrasound sensor and reflected by the floor surface on which prizes for the crane game machine are placed, means for detecting that the detected intensity of the ultrasound wave is not less than a predetermined intensity; and means for stopping down movement of the crane moved by the moving mechanism when it is detected that the detected intensity of the ultrasound wave is not less than the predetermined intensity.

* * * * *